US008073366B2

(12) United States Patent
Moon et al.

(10) Patent No.: US 8,073,366 B2
(45) Date of Patent: Dec. 6, 2011

(54) DEVELOPING UNIT AND IMAGE FORMING APPARATUS HAVING THE SAME

(75) Inventors: Ji-won Moon, Suwon-si (KR); Hyun-cheol Lee, Suwon-si (KR); Yun-kyu Sim, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 12/963,848

(22) Filed: Dec. 9, 2010

(65) Prior Publication Data

US 2011/0076064 A1 Mar. 31, 2011

Related U.S. Application Data

(63) Continuation of application No. 11/874,298, filed on Oct. 18, 2007, now Pat. No. 7,873,305.

(30) Foreign Application Priority Data

May 21, 2007 (KR) ..... 2007-49294

(51) Int. Cl.
*G03G 15/08* (2006.01)

(52) U.S. Cl. ..... 399/258; 399/255

(58) Field of Classification Search ..... 399/255, 399/256, 258
See application file for complete search history.

(56) References Cited

U.S. PATENT DOCUMENTS 4,351,604 A * 9/1982 Karasawa et al. ..... 399/232
5,345,298 A 9/1994 Corrigan, Jr. et al.
5,398,849 A 3/1995 Smith et al.
2005/0031381 A1 2/2005 Arimoto

OTHER PUBLICATIONS

CN Office Action issued Jun. 27, 2011 in CN Patent Application No. 2008100820791.

* cited by examiner

*Primary Examiner* — David Gray
*Assistant Examiner* — Barnabas Fekete
(74) *Attorney, Agent, or Firm* — Stanzione & Kim, LLP

(57) ABSTRACT

A developing unit of an image forming apparatus includes a developer cartridge detachably mounted on the developing unit, a developing case in which a developing member and a first supply member are provided, a developer supply passage to supply a developer stored in the developer cartridge to the developing case, and a developer supplement unit mounted in a portion connecting the developing case and the developer supply passage, to agitate the developer supplied through the developer supply passage and to supply the agitated developer to the developing case.

18 Claims, 5 Drawing Sheets

DEVELOPING UNIT AND IMAGE FORMING APPARATUS HAVING THE SAME

CROSS-REFERENCE TO RELATED APPLICATIONS

This is a Continuation Application of U.S. patent application Ser. No. 11/874,298, filed on Oct. 18, 2007,U.S. Pat. No. 7,873,305, in the U.S. Patent and Trademark Office, which claims priority under 35 U.S.C. §119 (a) of Korean Patent Application No. 10-2007-0049294, filed on May 21, 2007, in the Korean Intellectual Property Office, the disclosures of which are incorporated herein by reference in their entirety.

BACKGROUND OF THE INVENTION

1. Field of the Invention

The present general inventive concept relates to a developing unit in which a developer cartridge is detachably mounted, and an image forming apparatus having the developing unit.

2. Description of the Related Art

FIGS. 1 and 2 are views illustrating an example of an image forming apparatus.

In FIG. 1, the image forming apparatus capable of color printing includes a feeding unit 10, a plurality of developing units 20, a transferring unit 30, a fixing unit 40 and a discharging unit 50.

An image is printed on a sheet of paper picked up by the feeding unit 10 while the sheet of paper passes through the developing unit 20 and transferring unit 30. The printed image is then fused by the fixing unit 40, and the fused image is discharged to the outside of the image forming apparatus.

FIG. 2 is an enlarged view of the developing units 20 of FIG. 1. In FIG. 2, each of the developing units 20, which have different color toners, includes a developing roller 21, a photosensitive medium 22 and a cleaning unit 23, which are integrated with their respective developing units 20. A developer contained in the developing units 20 may form clumps over time due to internal stress, and accordingly vertical streaks may appear on the image during printing. In order to eliminate such streaks, the developer must be thoroughly agitated, and then supplied to the developing roller 21.

The developing roller 21, photosensitive medium 22 and cleaning unit 23 integrated with their respective developing units 20 of a compact image forming apparatus are often made to have similar service lives. However, in the case of a large-scale image forming apparatus (e.g., one used in an office), numerous sheets of paper are printed and the developer becomes exhausted more rapidly than the photosensitive medium 22 and cleaning unit 23. In order to reduce maintenance costs incurred by a user, a developer cartridge is needed which can supplement the developer without having to also replace the entire developing unit.

Accordingly, if a detachable developer cartridge is provided, the user can reduce maintenance costs for consumables, but various problems can arise when the developer contained in the developer cartridge is supplied to the developing unit.

For example, a separate supplying unit may be required to supply the developer discharged from the developer cartridge to the developing unit, which causes additional inconvenience for the user. Since the developer discharged from the developer cartridge tends to stick together, an image may not be uniformly printed if the developer is not sufficiently agitated. Thus, a structure which enables the supplied developer to be agitated may also be required according to the configuration of the supplying unit.

SUMMARY OF THE INVENTION

The present general inventive concept provides a developing unit and an image forming apparatus having the developing unit, in which the cost of replacing consumables can be reduced by having a separate developer cartridge, and in which the structure of an agitating unit can be improved to sufficiently agitate the developer.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing a developing unit of an image forming apparatus, the developing unit including a developer cartridge detachably mounted on the developing unit, a developing case in which a developing member and a first supply member are provided, a developer supply passage to supply a developer stored in the developer cartridge to the developing case, and a developer supplement unit mounted in a portion connecting the developing case and the developer supply passage, to agitate the developer supplied through the developer supply passage and to supply the agitated developer to the developing case.

The developing case may further include a second supply member disposed below the rotation axis of the first supply member.

The developer supplement unit may be disposed lengthwise along the developing case. The developer supplement unit may include a developer supply trench to contain the developer supplied from the developer supply passage, an agitator to transfer the developer contained in the developer supply trench, and a plurality of developer supply holes, which penetrate to the developer supply trench at regular intervals to discharge the developer to the developing case. A trench casing may be used to define the developer supply trench and the developer supply holes may penetrate the trench casing.

The plurality of developer supply holes may be provided in the form of slits arranged at a predetermined angle relative to a rotation axis of the agitator. The plurality of developer supply holes may be disposed in the side of the trench casing facing away from the developing member.

The developer supply passage may be formed of a flexible material. Opposing ends of the developer supply passage may be connected to one side of the developer cartridge and one side of the developing case, respectively.

The developer cartridge may include a plurality of first agitating members, and a second agitating member to agitate the developer discharged through the developer supply passage.

The second agitating member may be disposed adjacent to an inlet of the developer supply passage.

The developing case may further include a plurality of augers to agitate the developer supplied from the developer supplement unit, and a developer layer regulating member disposed in contact with the developing member to regulate a thickness of a developer layer attached to a surface of the developing member.

The plurality of augers may have the same diameter, and may include a first auger and a second auger to transfer the supplied developer in opposite directions. The side of the trench casing in which the developer supply holes are disposed may face the first auger and the second auger.

The first supply member may be disposed above rotation axes of the first auger and second auger, and an axis of the second supply member may be disposed below the rotation axes of the first auger and second auger.

The first supply member may face the developing member, and the second supply member may face the first supply member.

The developing member, the first supply member and the second supply member may be rollers. The developing member and the first supply member may be rollers, and the second supply member may be a supply agitator having a plurality of blades extending outwards from the center.

One or more predetermined voltages may be applied to the first supply member, the second supply member, the developing member and the developer layer regulating member. The voltage may be include alternating current (AC) part, and/or a direct current (DC) part.

The developing member, the first and second supply members, and the first and second augers may be of equal length.

A distance between the first supply member and the auger of the first and second augers, which is disposed closer to the first supply member, may be equal to or less than twice the diameter of either of the first auger and second auger.

A target developer level may be set at a level higher than the developer supply holes.

The bottommost portion of the developer supply trench may be disposed above the rotation axis of the first supply member.

The developer may include a mono-component non-magnetic developer.

The foregoing and/or other aspects and utilities of the present general inventive concept may also be achieved by providing a developing unit including a developer cartridge detachably mounted on the developing unit, a developing case disposed below the developer cartridge, the developing case including therein a developing roller, a first supply roller disposed below the developing roller, and one or more augers, a developer supply passage to connect the developer cartridge and the developing case, and to supply a developer stored in the developer cartridge to the developing case, and a developer supplement unit mounted in a portion connecting the developing case and the developer supply passage, to agitate the developer supplied through the developer supply passage and to supply the agitated developer to the developing case, wherein the developer supplement unit is disposed above a rotation axis of the first supply roller.

The developing case may further include a second supply roller disposed below the rotation axis of the first supply roller.

The one or more augers may include a first auger and a second auger, rotation axes of which are disposed above a rotation axis of the second supply roller. The rotation axes of the first auger and second auger may have the same height.

The developer supplement unit may be disposed lengthwise along the developing case. The developer supplement unit may include a developer supply trench to contain the developer supplied from the developer supply passage, an agitator to transfer the developer contained in the developer supply trench, and a plurality of developer supply holes, which penetrate to the developer supply trench at regular intervals to discharge the developer to the developing case. The plurality of developer supply holes may be provided in a trench casing defining the developer supply trench.

The plurality of developer supply holes may be provided in the form of slits arranged at a predetermined angle relative to a rotation axis of the agitator. The plurality of developer supply holes may be disposed in a side of a trench casing facing away from the developing member.

The foregoing and/or other aspects and utilities of the present general inventive concept may also be achieved by providing an image forming apparatus including a main body to constitute an exterior of the image forming apparatus, and a developing unit configured as mentioned above mounted in the main body to form an image on a printing medium.

A plurality of developing units may be mounted to form color images. It is desirable that four developing units may be provided to form images for each cyan (C), magenta (M), yellow (Y) and black (K).

The foregoing and/or other aspects and utilities of the present general inventive concept may also be achieved by providing a developing unit usable with an image forming apparatus, comprising a developer cartridge having a cartridge body to contain a developer, an agitating member disposed in the cartridge body to agitate the developer, and a developer outlet formed on the cartridge body to allow the agitated developer to be output to an outside of the cartridge body, wherein the developer outlet has an area smaller than an area of the agitator in a rotational axis direction of the agitator.

The foregoing and/or other aspects and utilities of the present general inventive concept may also be achieved by providing a developing unit useable with an image forming apparatus comprising a developer case having a case body to contain a developer, a developer inlet disposed on the case body to receive the developer from an external device, an agitating member disposed in to the developer inlet to agitate the received developer, a developer outlet disposed on the case body, and a developing member to supply the developer through the developer outlet, wherein the developer inlet has an area smaller than an area of the agitator in a rotational axis direction of the agitator.

The foregoing and/or other aspects and utilities of the present general inventive concept may also be achieved by providing a developing unit usable with an image forming apparatus, comprising a developer cartridge having a cartridge body to contain a developer, an agitating member disposed in the cartridge body to agitate the developer, and a developer outlet formed on the cartridge body to allow the agitated developer to be output to an outside of the cartridge body, wherein the developer outlet has an area smaller than an area of the agitator in a rotational axis direction of the agitator, a developer case having a case body to contain a developer, a developer inlet disposed on the case body to receive the developer from an external device, an agitating member disposed in to the developer inlet to agitate the received developer, a developer outlet disposed on the case body, and a developing member to supply the developer through the developer outlet, wherein the developer inlet has an area smaller than an area of the agitator in a rotational axis direction of the agitator, and a developer supply passage to connect the developer outlet of the developer cartridge and the developer inlet of the developer case.

The foregoing and/or other aspects and utilities of the present general inventive concept may also be achieved by providing an image forming apparatus comprising a paper feeding unit to feed a print medium, a developing unit to form an image on the printing medium, and comprising a developer cartridge having a cartridge body to contain a developer, an agitating member disposed in the cartridge body to agitate the developer, and a developer outlet formed on the cartridge body to allow the agitated developer to be output to an outside of the cartridge body, wherein the developer outlet has an area smaller than an area of the agitator in a rotational axis direction of the agitator, a developer case having a case body to contain a developer, a developer inlet disposed on the case body to receive the developer from an external device, an agitating member disposed in to the developer inlet to agitate the received developer, a developer outlet disposed on the case body, and a developing member to supply the developer through the developer outlet, wherein the developer inlet has an area smaller than an area of the agitator in a rotational axis direction of the agitator, and a developer supply passage to connect the developer outlet of the developer cartridge and the developer inlet of the developer case.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
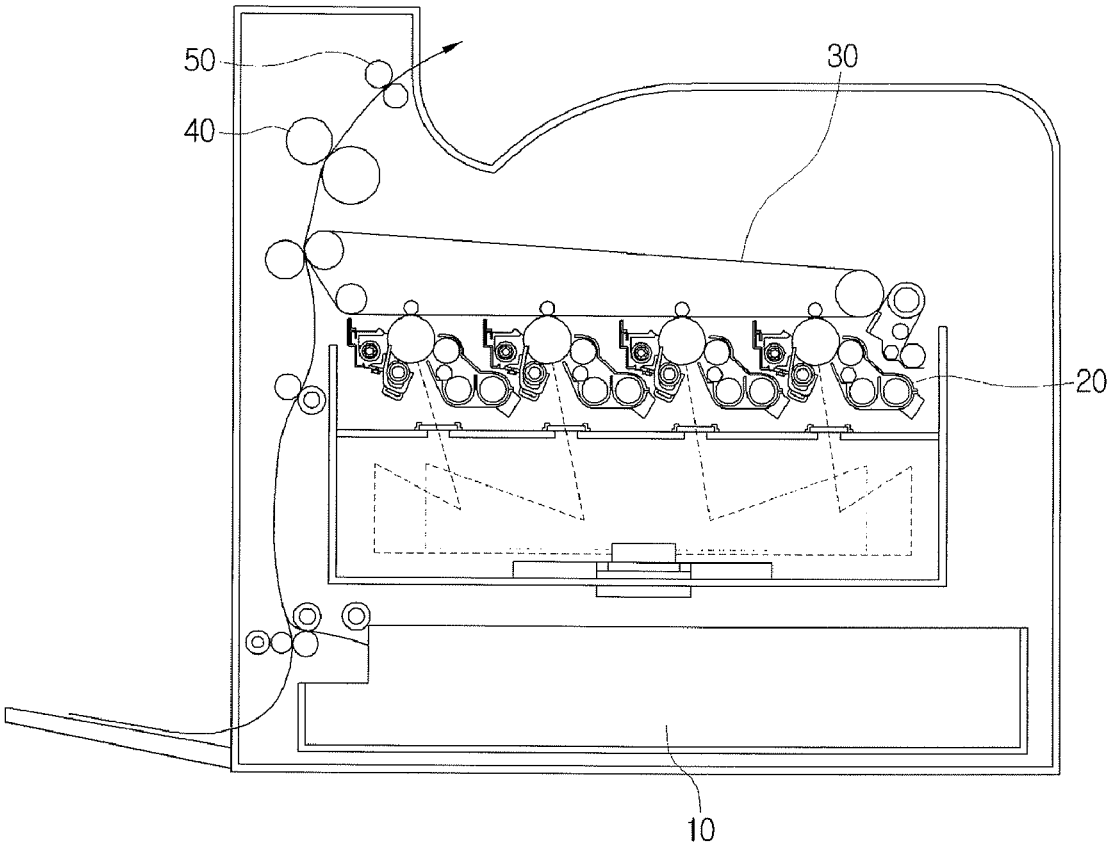
FIG. 1 (PRIOR ART)
FIG. 1 is a view illustrating a conventional image forming apparatus.
Figure 2:
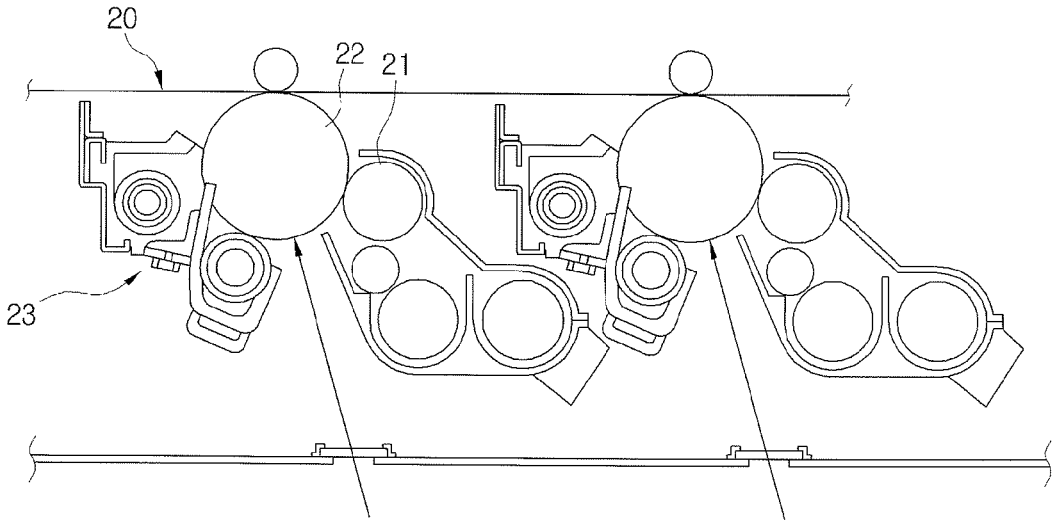
FIG. 2 (PRIOR ART)
FIG. 2 is an enlarged view of the developing units of FIG. 1.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 3:
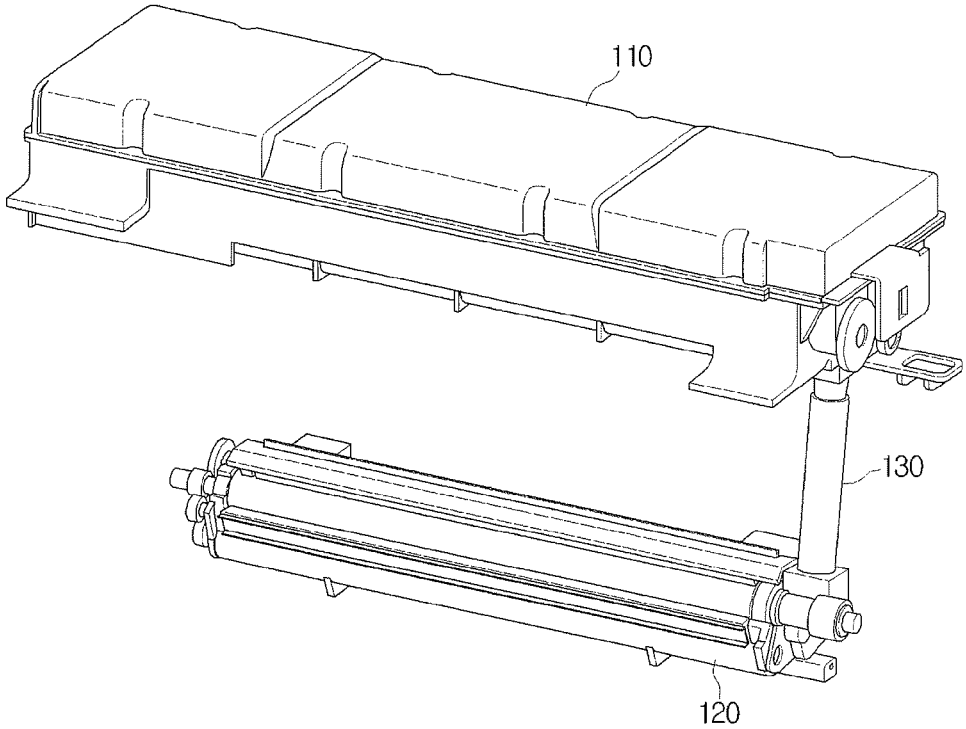
FIG. 3 is a perspective view illustrating a developing unit of an image forming apparatus according to an exemplary embodiment of the present general inventive concept.
Figure 4:
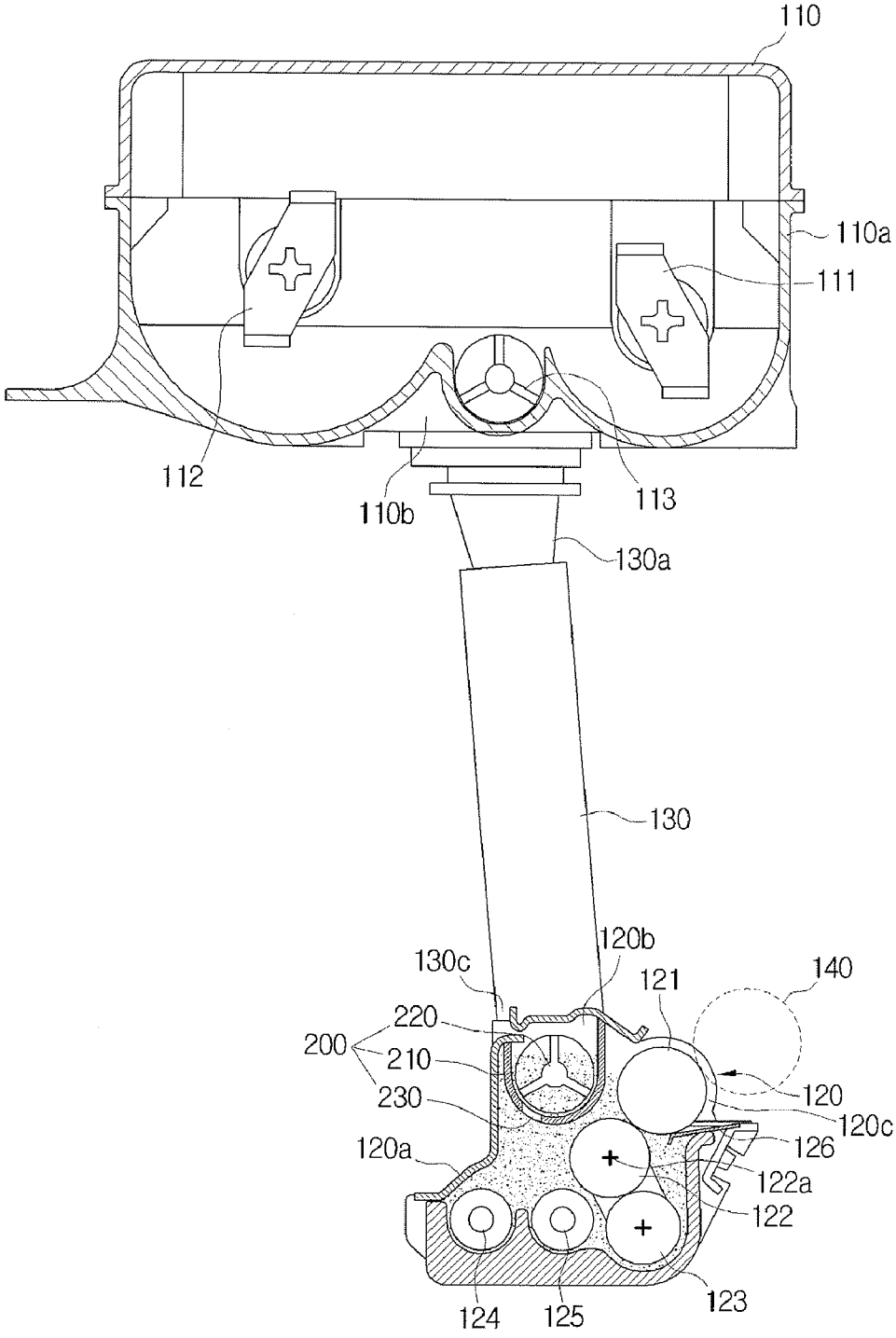
FIG. 4 is a sectional view of the developing unit of FIG. 3.
Figure 5:
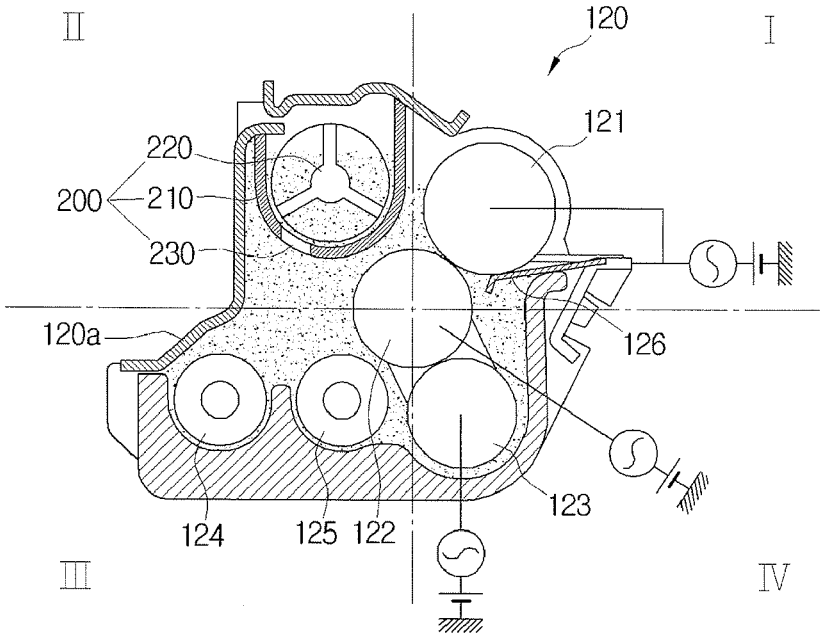
FIGS. 5 and 6 are sectional views of developing cases of image forming apparatuses according to exemplary embodiments of the present general inventive concept.

Referring to FIGS. 3 to 5, a developing unit usable with all image forming apparatus according to an exemplary embodiment of the present general inventive concept includes a developer cartridge 110, a developing case 120, a developer supply passage 130 and a developer supplement unit 200. The image forming apparatus may include a cassette to store a printing medium, a feeding unit that picks up and feeds the printing medium from the cassette to the developing unit and a discharging unit that discharges the printing medium with the image to form an image on the fed printing image. A conventional image forming apparatus such as FIG. 1, except for a conventional developing unit, can be used on the image forming apparatus of the present embodiment.

The developer cartridge 110 can contain a mono-component non-magnetic developer. The developer cartridge 110 can include a plurality of first agitating members 111 and 112, and a second agitating member 113. The first agitating members 111 and 112 can agitate the developer to prevent the developer from sticking together, and the second agitating member 113 can transfer the developer agitated by the first agitating members 111 and 112 to the developer supply passage 130.

The developing case 120 may be disposed below the developer cartridge 110 at a predetermined distance, so that parts of the image forming apparatus, such as a laser scanning unit (not illustrated) or a controlling unit, can be mounted therein. The developing case 120 may include a case body 120*a*, a developing member 121, a first supply member 122, a second supply member 123, a first auger 124, a second auger 125 and a developer layer regulating member 126. The structure of the developing case 120 will be described in detail later.

As illustrated in FIG. 3, the developer supply passage 130 can be formed between the developer cartridge 110 and the developing case 120, so as to link one side of the developer cartridge 110 to one side of the developing case 120. Accordingly, other parts such as a laser scanning unit (not illustrated) or the like can be easily mounted between the developer cartridge 110 and the developing case 120, so it is possible to reduce the size of the image forming apparatus. A photosensitive medium 140 may be disposed between the developer cartridge 110 and the developing case 120. The photosensitive medium 140 may be disposed—the developer supply passage 130. The developer supply passage 130 may be formed of a flexible material so that the parts can be easily assembled and the developer can be smoothly supplied.

The developer supply passage 130 may be beside a flexible tube. The developer supplement unit 200 can include a developer supply trench 210, an agitator 220 and a plurality of developer supply holes 230.

The developer supply trench 210 may have a length corresponding to a length of the developing case 120, and can contain the developer supplied from a main inlet 131 (referring to FIG. 7) of the developer supply passage 130. As illustrated in FIG. 4, the bottommost portion of the developer supply trench 210 can be disposed above a rotation axis 122*a* of the first supply member 122.

Figure 7:
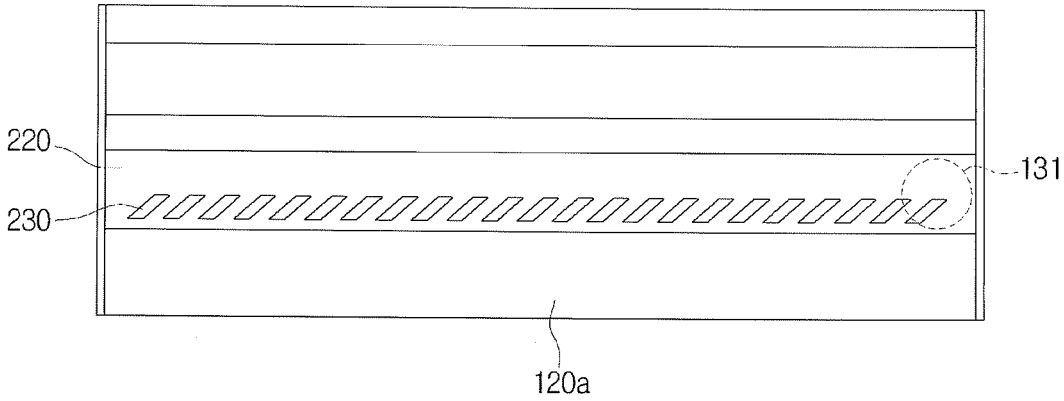
FIG. 7 is a plane view of a developing case of an image forming apparatus according to an exemplary embodiment of the present general inventive concept.

The agitator 220 can be rotatably mounted within the developer supply trench 210, to pulverize and transfer the supplied developer. Since the main inlet 131 may be disposed at a terminal end of the developer supply trench 210 as illustrated in FIG. 7, the agitator 220 is should uniformly disperse and agitate the supplied developer throughout the entire developer supply trench 210.

The plurality of developer supply holes 230 can penetrate to the developer supply trench 210 at regular intervals, to discharge the developer to the developing case 120. Each of the plurality of developer supply holes 230 can be provided in the form of slits arranged at a predetermined angle relative to a rotation axis of the agitator 220.

Providing the developer supply holes 230 to have a slit shape as described above assists the developer to be provided in equal amounts through the plurality of developer supply holes 230, and help prevent stress from being generated due to clumping of the developer on the developing member 121.

Additionally, the developer supply holes 230 may be disposed so as not to face the developing member 121. If the developer supply holes 230 face the developing member 121, it is more likely that the developer supplemented through the developer supply holes 230 may be attached to a surface of the developing member 121 directly without an intervening agitating operation. According to the arrangement of the developer supply holes 230 of the embodiments of FIGS. 5 and 6, supplemented developer may be applied with approximately the same concentration on the surface of the developing member 121 with little likelihood of coagulation.

The developer cartridge 110 may include a cartridge body 110*a* and a developer outlet disposed adjacent to the agitator 113. The developer outlet may have an area smaller than an area of an inside of the cartridge body 110*a* and/or an area of the agitator 113 in a rotational axis direction of the agitator 113. The developer supply passage 130 may have a first end

130*a* and a second end 130*c* to be connected to the developer outlet 110*b* and a developer inlet 120*b* of the developer case 120. The developer inlet 120*b* has an area smaller than an area of an inside of the cartridge body 110*a* and/or an area of the agitator 113 in a rotational axis direction of the agitator 113. The developer case 120 has a developer outlet where the developing member 121 is disposed.

Hereinafter, the structure of the developing case 120 will be described in detail.

The case body 120*a* includes the developing member 121, the first and second supply members 122 and 123, and the first and second augers 124 and 125, which are rotatably mounted therein.

The developing member 121 can face the photosensitive medium 140 illustrated in FIG. 4, to transfer the developer attached by the first and second supply members 122 and 123 onto an electrostatic latent image formed on the photosensitive medium 140 to form a visible image. The developing member may be a developing roller or other type.

The first and second supply members 122 and 123 can supply the developer from the developer cartridge 110 to the developing member 121. For this, the first and second supply members 122 and 123 can be charged to have a predetermined potential difference with respect to the developing member 121, so that the developer can be electrostatically transferred.

The first and second augers 124 and 125 may have the same diameter, and can agitate the supplied developer and transfer the supplied developer in opposite directions. The first and second augers 124 and 125 may face the plurality of developer supply holes 230, and accordingly the developer supplied through the developer supply holes 230 can be sufficiently agitated before the developer is transferred to the developing member 121 by the first supply member 122.

Figure 6:
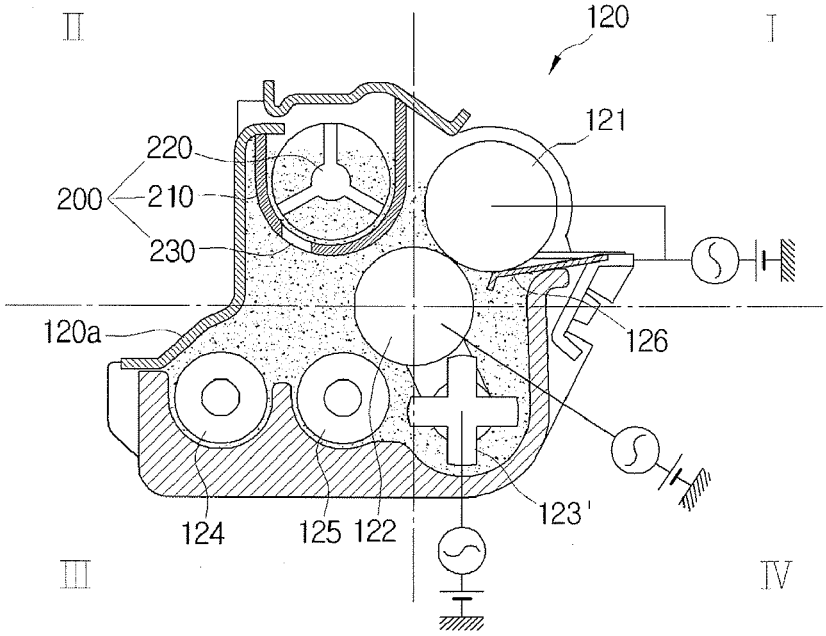

As illustrated in FIGS. 4 to 6, the rotation axis 122*a* of the first supply member 122 may be disposed above the rotation axes of the first and second augers 124 and 125. A rotation axis of the second supply member 123 may be disposed below the rotation axes of the first and second augers 124 and 125.

The first supply member 122 may convey the developer supplied from the developer supplement unit 200 towards the developing member 121, so the first supply member 122 may be disposed in a position closer to the developer supplement unit 200 than that of the second supply member 123.

The second supply member 123 may convey the developer regulated by the developer layer regulating member 126 towards the first supply member 122, and thus the second supply member 123 may be disposed below the first supply member 122 so as to draw up the developer deposited on the bottom surface of the case body 121*a* towards the first supply member 122.

Accordingly, as illustrated in the drawings, the first supply member 122 may face the developing member 121, and the second supply member 123 may face the first supply member 122.

The first supply member 122 may be disposed close to the second auger 125. Specifically, a distance between the first supply member 122 and the second auger 125 is preferred to be no more than twice the diameter of either of the first auger 124 and second auger 125. If the distance between the first supply member 122 and the second auger 125 is more than twice the diameter of either of the first auger 124 and second auger 125, the developer conveyed to the first supply member 122 may not be sufficiently agitated, making it difficult to form a consistent image.

According to the exemplary embodiment of the present general inventive concept illustrated in FIG. 5, both the first and second supply members 122 and 123 are rollers. Alternatively, according to another exemplary embodiment of the present general inventive concept, the first supply member 122 may be a roller and the second supply member 123 may be a supply agitator 123' having a plurality of blades extending outwards from the center, as illustrated in FIG. 6. Other configurations for the supply members 122 and 123 may be used as desired.

Voltages may be applied to the developing member 121, the first and second supply members 122 and 123, and the developer layer regulating member 126. The voltages may include an alternating current (AC) component, a direct current (DC) component, or, as illustrated, both an alternating current (AC) component and direct current (DC) component.

The developing member 121, the first and second supply members 122 and 123, and the first and second augers 124 and 125 can be of equal length, so that the efficiency of agitating the developer can be maximized.

A target developer level of the developing case 120 can be set at a level higher than the developer supply holes 230, as illustrated in FIGS. 5 and 6. Although not illustrated in the drawings, a developer sensor including a light emitting unit and a light receiving unit can be mounted above the developer supply holes 230, to sense the presence of the developer so that the target developer level of the case body 120*a* can be maintained at a level higher than the developer supply holes 230. Maintaining the developer level at such a target developer level helps reduce clumping of the supplied developer.

In order to facilitate understanding of the arrangement of the components described above, description will be given using the first supply member 122 as the center, referring to FIGS. 5 and 6.

The above parts can be configured with the first supply member 122 as the center. Specifically, the developing member 121 may be disposed in quadrant I, and the developer supplement unit 200 may be disposed in quadrant II with developer supply holes provided so as not to face the developing member 121, as described above. The first and second augers 124 and 125 may be disposed in quadrant III to agitate and transfer the developer supplied from the developer supply holes 230. Additionally, the second supply member 123 may be disposed in quadrant IV to draw up the developer regulated by the developer layer regulating member 126 towards the first supply member 122.

The developing unit according to the exemplary embodiment of the present general inventive concept may be applied to a mono-color image forming apparatus, or to a full-color image forming apparatus. In the case of a full-color image forming apparatus, a plurality of developing units having color toners of various colors can be provided.

As described above, according to the exemplary embodiments of the present general inventive concept, only a developer cartridge in which a developer is consumed may be replaced, and thus it is possible to reduce the cost of replacing consumables. Additionally, a developer is sufficiently agitated by an agitating unit disposed above a supply roller and is then supplied to a developing case, so it is possible to prevent clumps forming in the developer and the appearance of vertical streaks due to the clumping.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents. As used in this disclosure, the term "preferably" is non-exclusive and means "preferably, but not limited to." Terms in the claims should be given their broadest interpretation consistent with the general inventive concept as set forth in this description. For example, the terms "coupled" and "connect" (and derivations thereof) are used to connote both direct and indirect connections/couplings. As another example, "having" and "including", derivatives thereof and similar transition terms or phrases are used synonymously with "comprising" (i.e., all are considered "open ended" terms)—only the phrases "consisting of" and "consisting essentially of" should be considered as "close ended". As used in the claims, the terms describing the relative positional relationships of various elements of an apparatus, such as "below" and "above", describe these positional relationships with respect to the position of the apparatus in its operating environment. Claims are not intended to be interpreted under 112 sixth paragraph unless the phrase "means for" and an associated function appear in a claim and the claim fails to recite sufficient structure to perform such function.

What is claimed is:

1. A developing unit of an image forming apparatus, the developing unit comprising:

a developing roller;

a first supply roller;

a second supply roller; and at least on auger, wherein the second supply roller supplies a developer to the first supply roller and the first supply roller supplies the developer to the developing roller, so that the developing roller transfers the developer supplied by the first and second supply rollers onto an electrostatic latent image formed on a photosensitive medium, and wherein a rotation axis of the second supply roller is disposed within a space defined between a first vertical plane containing a rotation axis of the first supply roller and a second vertical plane containing a rotation axis of the developing roller.

2. The developing unit of claim 1, wherein the rotation axis of the first supply roller is disposed below the rotation axis of the developing roller and the rotation axis of the second supply roller is disposed below the rotation axis of the first supply roller.

3. The developing unit of claim 1, wherein the developing unit further comprises:

a developer cartridge detachably mounted on the developing unit;

a developing case in which the developing roller, the first and second supply rollers, and the at least one auger are provided;

a developer supply passage to supply a developer stored in the developer cartridge to the developing case; and a developer supplement unit mounted in a portion connecting the developing case and the developer supply passage, to agitate the developer supplied through the developer supply passage and to supply the agitated developer to the developing case.

4. The developing unit of claim 3, wherein the developer supplement unit comprises:

a developer supply trench to contain the developer supplied from the developer supply passage; and an agitator to transfer the developer contained in the developer supply trench.

5. The developing unit of claim 4, wherein the bottommost portion of the developer supply trench is disposed above the rotation axis of the first supply roller.

6. The developing unit of claim 4, wherein the developer supplement unit further comprises a trench casing defining the developer supply trench, the trench casing having a plurality of developer supply holes which penetrate to the developer supply trench at regular intervals to discharge the developer to the developing case.

7. The developing unit of claim 6, wherein the plurality of developer supply holes are provided in the form of slits arranged at a predetermined angle relative to a rotation axis of the agitator.

8. The developing unit of claim 6, wherein the plurality of developer supply holes are disposed in a side of the trench casing facing away from the developing roller.

9. The developing unit of claim 6, wherein the plurality of developer supply holes are disposed in a side of the trench casing facing the at least one auger.

10. The developing unit of claim 3, wherein opposing ends of the developer supply passage are connected to one side of the developer cartridge and one side of the developing case, respectively.

11. The developing unit of claim 3, wherein the developer cartridge comprises:

a plurality of first agitating members; and at least one second agitating member to agitate the developer discharged through the developer supply passage.

12. The developing unit of claim 1, wherein the first supply roller is disposed above rotation axes of the at least one auger, and an axis of the second supply roller is disposed below the rotation axes of the at least one auger.

13. The developing unit of claim 1, wherein the developing unit comprises first and second augers, and wherein a distance between the first supply roller and one of the first and second augers which is disposed closer to the first supply roller is equal to or less than twice the diameter of either of the first and second augers.

14. An image forming apparatus comprising:

a main body to constitute an exterior of the image forming apparatus; and a developing unit mounted in the main body to form an image on a printing medium, wherein the developing unit comprises a developing roller;

a first supply roller;

a second supply roller; and at least one auger, wherein the second supply roller supplies a developer to the first supply roller and the first supply roller supplies the developer to the developing roller, so that the developing roller transfers the developer supplied by the first and second supply rollers onto an electrostatic latent image formed on a photosensitive medium, and wherein a rotation axis of the second supply roller is disposed within a space defined between a first vertical plane containing a rotation axis of the first supply roller and a second vertical plane containing a rotation axis of the developing roller.

15. The image forming apparatus of claim 14, wherein the rotation axis of the first supply roller is disposed below the rotation axis of the developing roller and the rotation axis of the second supply roller is disposed below the rotation axis of the first supply roller.

16. The image forming apparatus of claim 14, wherein the developing unit further comprises:

a developer cartridge detachably mounted on the developing unit;

a developing case in which the developing roller, the first and second supply rollers, and the at least one auger are provided;

a developer supply passage to supply a developer stored in the developer cartridge to the developing case; and a developer supplement unit mounted in a portion connecting the developing case and the developer supply passage, to agitate the developer supplied through the developer supply passage and to supply the agitated developer to the developing case.

17. The image forming apparatus of claim 16, wherein the developer supplement unit comprises:

a developer supply trench to contain the developer supplied from the developer supply passage; and an agitator to transfer the developer contained in the developer supply trench.

18. The image forming apparatus of claim 17, wherein the developer supplement unit further comprises a trench casing defining the developer supply trench, the trench casing having a plurality of developer supply holes which penetrate to the developer supply trench at regular intervals to discharge the developer to the developing case.

* * * * *